United States Patent [19]

Grafton

[11] Patent Number: 4,594,206

[45] Date of Patent: Jun. 10, 1986

[54] CONCRETE STRUCTURES FOR USE IN SHORE PROTECTION AND/OR WAVE CONTROL AND METHOD OF MAKING SAME

[76] Inventor: Harry D. Grafton, 869 Wagar Rd., Rocky River, Ohio 44116

[21] Appl. No.: 596,851

[22] Filed: Apr. 5, 1984

Related U.S. Application Data

[63] Continuation-in-part of Ser. No. 534,193, Sep. 21, 1983, abandoned.

[51] Int. Cl.[4] ..... E02B 3/14

[52] U.S. Cl. ..... 264/35; 264/31; 264/86; 264/257; 264/314; 264/316; 405/29; 405/32; 405/35

[58] Field of Search ..... 405/15–35; 264/32, 35, 31, 86, 256, 257, 333, 313, 314, 316; 52/608, 609

[56] References Cited

U.S. PATENT DOCUMENTS

| | | | |
|---|---|---|---|
| Re. 27,460 | 8/1972 | Lamberton | 264/35 |
| 1,421,857 | 7/1922 | Störe | 264/32 |
| 2,766,592 | 10/1956 | Danel et al. | 405/29 |
| 3,555,751 | 1/1971 | Thorgusen | 264/35 |
| 3,561,219 | 2/1971 | Nishizawa et al. | 405/19 |
| 3,636,713 | 1/1972 | O'Neill | 405/29 |
| 3,726,950 | 4/1973 | Turzillo | 264/32 |
| 4,022,859 | 5/1977 | Fioretto | 264/69 |
| 4,154,061 | 5/1979 | Umemoto et al. | 405/19 |
| 4,420,275 | 12/1983 | Ruser | 405/18 |

FOREIGN PATENT DOCUMENTS 2028712A 3/1980 United Kingdom .

OTHER PUBLICATIONS

"Tetrapod Forms now on Market", Engineering News--Record, Feb. 28, 1957, p. 63.

*Primary Examiner*—Jay H. Woo
*Assistant Examiner*—James Housel
*Attorney, Agent, or Firm*—Renner, Otto, Boisselle & Lyon

[57] ABSTRACT

Concrete structures consist of fabric containers which are filled with concrete through an opening in the top thereof while the top of the container is suspended from a portable support frame placed over the container. The support frame supports the container in an open and upward position with the bottom wall of the container resting on the ground while concrete is pumped or chuted into the container through the top opening.

20 Claims, 11 Drawing Figures

CONCRETE STRUCTURES FOR USE IN SHORE PROTECTION AND/OR WAVE CONTROL AND METHOD OF MAKING SAME

CROSS-REFERENCE TO RELATED APPLICATION

This application is a continuation-in-part of U.S. Patent Application Ser. No. 534,193, filed Sept. 21, 1983, now abandoned, and entitled "Improved Concrete Structures for Use in Wave Control and Method of Making Same".

BACKGROUND OF THE INVENTION

This invention relates generally as indicated to improved concrete structures for use in shore protection and/or wave control and the method of making same. More particularly, such invention is concerned with the making of concrete structures which may be similar in shape to previous known concrete structures but which have improved strength characteristics and can be mass produced more easily and economically than heretofore.

The shorelines along lakes and rivers as well as along coastal regions are being eroded away at an alarming rate. Numerous methods have been tried in an attempt to control this problem with mixed results. An acceptable method of shore protection for flat or moderate offshore slopes is to construct a breakwall or offshore breakwaters some distance from the shoreline. Such a breakwall can be constructed of any material capable of withstanding the wave energies impinging on them, including stone, gabions, steel, wood, and concrete shapes.

One objection to most concrete structures is their relatively high cost of manufacture and transporting to the site where they are to be installed. One such concrete structure is generally in the shape of a block which is typically precast at a manufacturing location and then transported to the job site, which greatly adds to the cost of the installation.

Another concrete structure that has been effectively used in certain installations is called a dolos or dolosse (plural). Such dolosse are also typically precast at a remote location and transported to the site for installation at substantial expense. The conventional dolos consists of two cross members which extend generally perpendicular to each other in different planes and are connected together by an intermediate member at their midpoints. Each cross member is tapered in opposite directions from the center to the ends thereof, and is generally octagonal in cross section, having eight flat sides extending around the periphery and relatively sharp angled edges where the octagon sides meet. Any number of these dolosse can be randomly piled one on top of the other with the cross members overlapping each other to form a relatively stable structure which is effective in absorbing and dispersing wave energies.

Another possible objection to the use of such conventional dolos is the relatively sharp angled or fluted edges where the octagon sides meet which set up stresses where weakness and fracture could result.

Also, metal forms were typically used to make such concrete structures, which not only requires a relatively high capital investment but such metal forms have a relatively short useful life. In addition, such metal forms require high maintenance and repair, and are difficult to clean.

A further objection to the use of metal forms is that they cause air and moisture to be entrapped at the surface of the concrete structures resulting in reduced surface strength.

SUMMARY OF THE INVENTION

With the foregoing in mind, it is a principal object of this invention to provide concrete structures of the type generally described but which are considerably less expensive to manufacture and install.

Another object is to provide such concrete structures with improved surface strength.

A further object is to provide a method which makes economical the on-site production of such concrete structures.

Another object is to provide a method of making such concrete structures which requires very little capital investment and completely eliminates the need for having to use metal forms and the like.

These and other objects of the present invention may be achieved by utilizing fabric forms in the production of the concrete structures. The forms are made of a suitable breathable fabric which releases entrapped air and surface water from the concrete while retaining moisture for curing, whereby the surface strength of the concrete is increased. Such fabric forms are relatively inexpensive, thus making them expendable whereby they can remain as part of the concrete structures. Also, because such fabric forms are relatively lightweight, they can easily and economically be transported to the job site for on-site manufacture of the concrete structures at minimum cost.

The concrete is preferably a fiber reinforced concrete, with short, thin fibers made either of metal or a non-metallic material such as fiberglass or polypropylene used to provide a homogeneous concrete mass having high impact resistance, toughness, tensile strain and fatigue performance. Alternatively, steel reinforcement bars may be inserted into the concrete in the fabric form through an opening in the top thereof. Also, a suitable plasticizer may be added to make the concrete more flowable but retain its strength.

Portable support frames are used to support the open end of the fabric containers while they are being filled with concrete. Such support frames should remain in place until the concrete sets, which takes approximately two to three hours. Thereafter, the frames can be removed and used to support other fabric containers during the pour and set.

To the accomplishment of the foregoing and related ends, the invention, then, comprises the features hereinafter fully described and particulary pointed out in the claims, the following description and the annexed drawings setting forth in detail certain preferred embodiments of the invention, these being indicative, however, of but several of the various ways in which the principles of the invention may be employed.

DETAILED DESCRIPTION OF THE PREFERRED EMBODIMENTS

Figure 1:
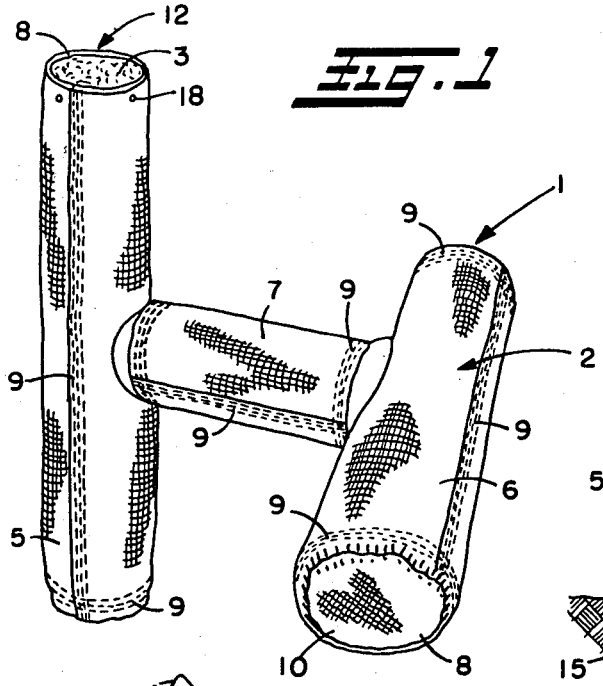
FIG. 1 is a perspective view of one form of concrete structure constructed in accordance with the present invention.

Referring now in detail to the drawings and initially to FIG. 1 thereof, one form of concrete structure in accordance with this invention for use in wave control is generally indicated by the reference numeral 1. As shown, such concrete structure consists of a fabric container or form 2 filled with concrete 3. Preferably, the concrete is fiber reinforced concrete. The fibers may, for example, be one to two inches long and under one percent of the volume of the concrete. Such fibers may either be made of metal or of a non-metallic material such as fiberglass or polypropylene which results in a concrete structure consisting of a homogeneous mass of concrete having high impact resistance, toughness, tensile strain and fatigue performance. A suitable plasticizer may also be added to the concrete to increase its strength.

Figure 1A:
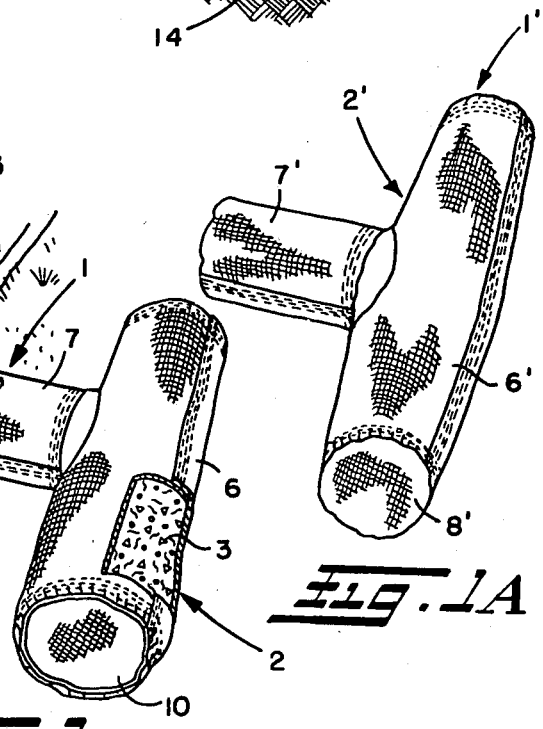
FIG. 1*a* is a fragmentary perspective view of another form of concrete structure in accordance with this invention which is substantially the same as the concrete structure of FIG. 1 except that the cross members are slightly tapered from the center toward the opposite ends thereof.

The concrete structure 1 is generally in the shape of a conventional dolos, including a pair of cross members 5, 6 which are generally perpendicular to each other in different planes and are connected together by an intermediate member 7 at their midpoints. However, the cross members and intermediate member, rather than being of a generally octagonal shape in cross section with flat sides and sharp angles at the edges where the octagon sides meet as in a conventinal dolos, are substantially circular in cross section to avoid any high stress points. Also, the members 5, 6 as well as the intermediate member 7 may be substantially cylindrical throughout their length as shown in FIG. 1, or such cross members may taper slightly from their midpoints toward the opposite ends thereof to place more mass at their centers as shown in FIG. 1A. Otherwise, the concrete structure shown in FIG. 1A is substantially the same as the concrete structure of the FIG. 1 embodiment, and the same reference numerals followed by a prime (') symbol are used to designate like parts. In either case, the end walls 8 or 8' of the cross members are desirably flat.

Although the size of such concrete structures may vary widely depending on the desired weight for a particular installation, a typical size would be one in which the diameters of the cross members and intermediate member are in the range of 14 to 18 inches, with the cross members being approximately 5 to 6 feet long and the intermediate member being approximately 2 to 3 feet long, resulting in a concrete structure weighing in the range of four to five thousand pounds. Moreover, where the cross members are tapered from the middle toward the opposite ends as shown in FIG. 1A, the center portion of the cross members may have a diameter for example of approximately 16 inches and taper downwardly to approximately 12 inches at the ends.

Of course, the initial diameter of the cross members and intermediate member of the fabric container prior to being filled with concrete should be somewhat smaller than the final desired diameter, for example, one to two inches, due to some stretching of the fabric during the filling operation. The fabric itself should be a breathable industrial grade fabric such as a 6.5 ounce uncoated woven polypropylene which releases entrapped air and surface water dduring filling of the container with concrete while retaining moisture for curing of the concrete. Also, the fabric should desirably be treated to resist degradation by ultra-violet sunrays.

All of the seams 9 of the fabric container are stitched together by lock stitching. Also, three of the four ends of the fabric cross members 5, 6 are closed by flat fabric end pieces 10 which are also lock stitched to the ends of the cross members. One end 12 is left open to permit filling of the fabric container with concrete in a manner to be subsequently described.

Such a fabric container is relatively inexpensive to manufacture, thus making it expendable whereby it may be incorporated as part of the concrete structure. Also, as previously indicated, the fabric container may readily be made of any desired size depending on the particular job requirements.

Another important advantage in using fabric containers for the concrete structures is that they readily lend themselves to on-site production of the concrete structures. The fabric containers, being relatively lightweight and easily compacted when empty, can easily be transported to the job site, thus eliminating the substantial expense of having to transport the concrete structures themselves substantial distances from a single manufacturing location to the various job sites. Of course, if the concrete structures are made at the job site, the concrete itself can be obtained locally so that there is little or no added expense there.

Figure 3:
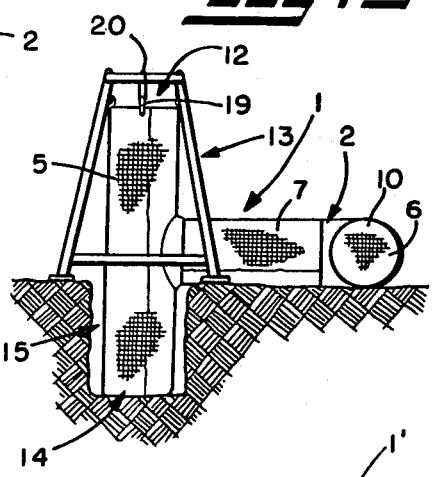
FIG. 3 is a side elevation view on a reduced scale of the fabric container and support frame of FIG. 2, showing the end of the cross member opposite the open end extending into an opening in the ground and another cross member and an intermediate member of the fabric container resting on the ground.
Figure 2:
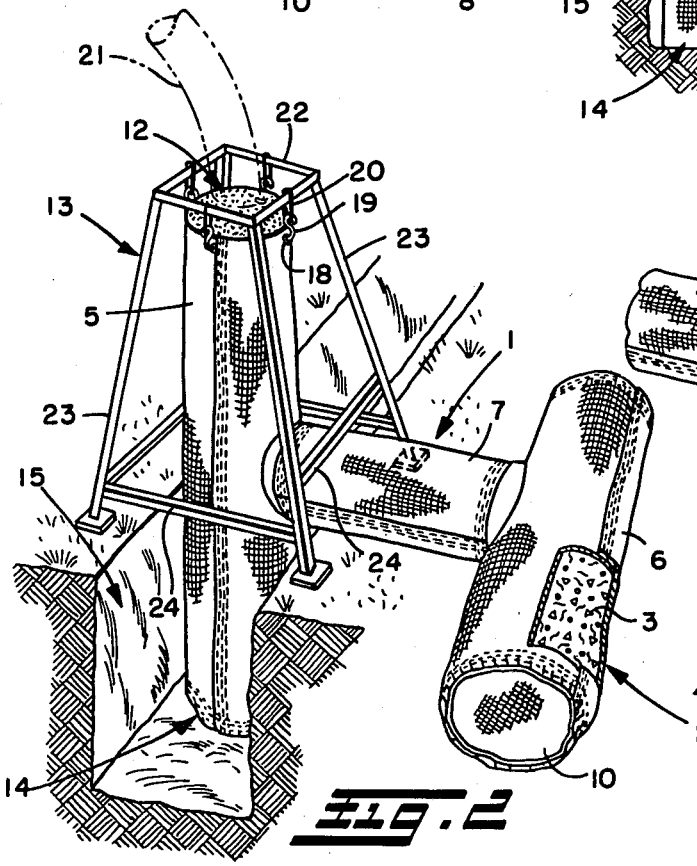
FIG. 2 is a perspective view, partly in section, showing the preferred method of making such concrete structures utilizing a fabric form or container having a cross member with an open end, which open end is suspended from a suitable support frame during gravity filling of the container with concrete through the open end.

To facilitate filling of the fabric containers with concrete, the open end 12 of the container is desirably suspended from above ground level by a suitable support frame 13, and the opposite end 14 extends into a trench or opening 15 in the ground (see FIGS. 2 and 3). The depth of the trench should be such that the closed bottom of the one cross member 5 opposite the open end will be fully supported by the bottom of the trench and the other cross member 6 and intermediate member 7 will be fully supported on the ground adjacent the opening as the fabric container is filled with concrete through the open end. Likewise, the support frame 13 should extend high enough off the ground to maintain the substantially vertical orientation of the one cross member 5 during the filling operation. The trench 15 should have a width somewhat greater than the diameter of the one cross member 5 when filled with concrete so as not to interfere with the subsequent removal therefrom.

The open end of the fabric container may be attached to the support frame by any suitable means, for example, by providing four grommets 18 around the periphery of the open end, and providing a corresponding number of generally S-shape hooks 19 having one end extending through one of the grommets and the other end connected to the frame by elastic cords 20 as shown in FIGS. 2 and 3. Also, the open end of the fabric container may be reinforced as by providing a rolled seam at such open end before insertion of the grommets therein. The purpose of the elastic cords is to allow some slight sagging of the vertical cross member 5 as it is filed with concrete, and to permit the support frame to be disconnected easily from the concrete filled fabric container after the concrete sets.

A concrete pump may be used to pump the fiber reinforced concrete from a mixer to the open end of the fabric container through a hose 21, shown in phantom lines in FIG. 2. First the concrete fills the portion of the one cross member 5 below ground level, then it travels through the intermediate member 7 and fills the other cross member 6 and intermediate member 7, and finally fills the upper portion of the cross member 5.

Normally it has been found that the only place the one cross member need be supported during the filling operation is at the open end and of course at the bottom. Accordingly, the support frame 13 may be a simple A frame or tripod construction of the type shown in FIGS. 2 and 3, consisting of an upper frame member 22 supported by four angularly extending legs 23, and four cross braces 24. The upper frame member may be of a generally rectangular shape as shown or an annular ring. The legs should of course straddle the opening 15 in the ground. Also, two of the legs should straddle the intermediate member, with the cross brace between these two legs being high enough to clear the top of the intermediate member when filled with concrete.

Figure 4:
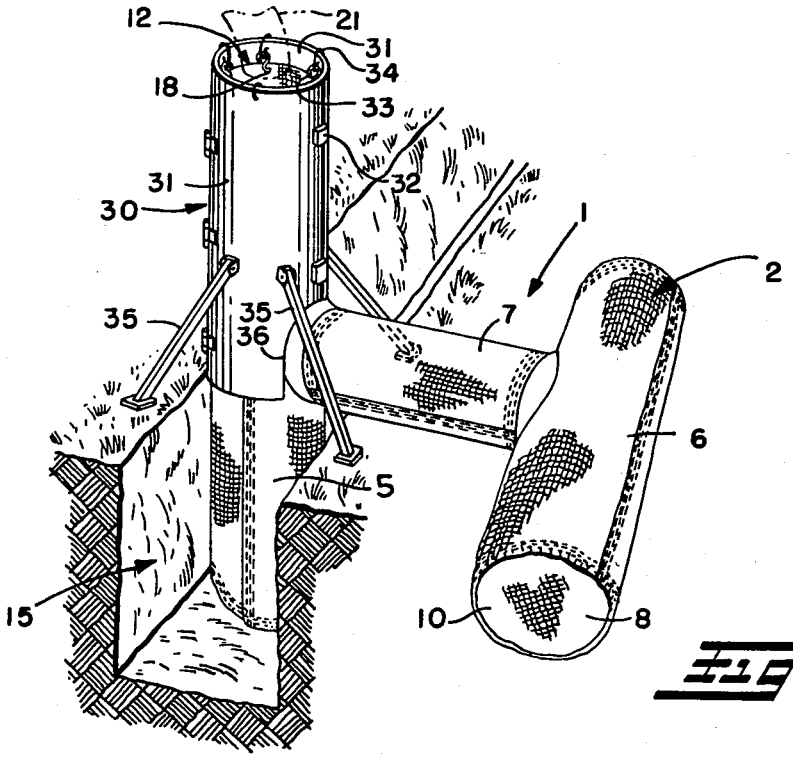
FIG. 4 is a perspective view similar to FIG. 2 but showing another support frame for supporting the fabric container during filling with concrete.

If greater support for that portion of the cross member 5 extending above ground level is desired, a more stable support frame 30 such as shown in FIG. 4 could be used, including a pair of semi-cylindrical members 31 hinged together along one edge and having a releasable latch 32 at the other edge. A pair of hooks 33 and associated elastic cords 34 may be attached to each semi-cylindrical portion adjacent the top thereof for connection to the open end of the fabric container as before. Also, a pair of folding support legs 35 may extend outwardly from each semi-cylindrical portion to support the frame structure above the ground. If the support member is made to extend downwardly below the intermediate member 7 when the intermediate member is filled with concrete, cut-outs 36 must be provided along the sides of the semi-cylindrical portions adjacent the intermediate member to accommodate such expansion of the intermediate member as further shown in FIG. 4.

Regardless of which type of support frame is used, the support frame need only be left in place until the concrete sets, which takes approximately two to three hours. Thereafter, the support frame can be removed and reused to suspend another fabric container while it is being filled with concrete. The concrete structures themselves should be left in place to cure for at least twenty-four to thirty-six hours before they are moved.

For large production runs, one or more slit trenches 40 may be dug in the ground each having the required depth to support the closed bottom of the vertically oriented cross member in the manner previously described and having a width slightly greater than the expanded diameter of such cross member when filled with concrete. The trenches may be of any desired length depending on the number of concrete structures to be made at any given time.

Figure 5:
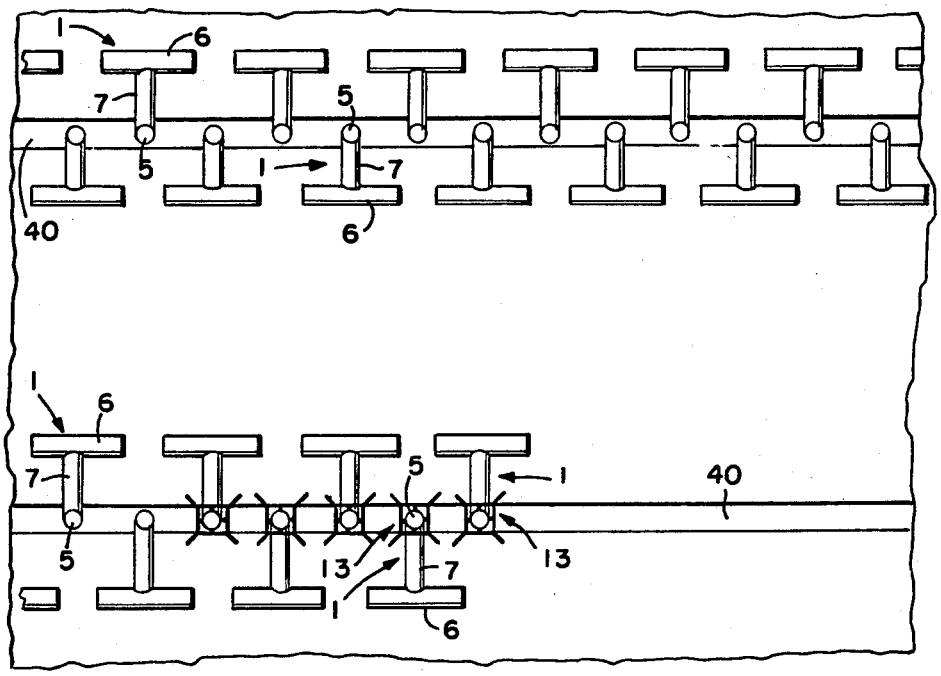
FIG. 5 is a schematic plan view showing on-site production of any number of concrete structures utilizing the method shown in FIGS. 2, 3 and 4.

In the example shown in FIG. 5, two such trenches 40 are shown, each spaced apart a sufficient distance, for example, twenty feet, to provide sufficient room both for two rows of support structures 1 extending toward each other and for the passage of a concrete mixer or the like therebetween. For maximum trench utilization, the intermediate members 7 of the concrete structures should alternately extend in opposite directions from the trench as further shown in FIG. 5 to permit the production to be substantially doubled.

Of course, as previously indicated, each support frame 13 or 30 should be left in place for approximately two to three hours after the fabric containers are filled with concrete. Accordingly, several such support frames will have to be provided to maximize production in a single shift. For example, assuming it takes each crew approximately fifteen minutes to set up and fill each fabric container with concrete, each crew would have to be provided with a minimum of ten to fifteen such support frames in order to operate at maximum production.

Figure 6:
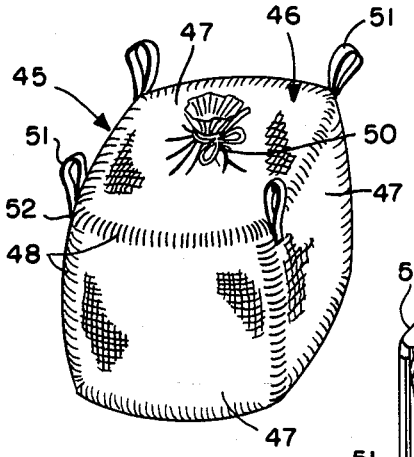
FIG. 6 is a perspective view of still another form of concrete structure in accordance with this invention.

FIG. 6 shows another form of concrete structure 45 in accordance with this invention which may be used either for shore protection or as a breakwall. As shown, such concrete structure 45, like the concrete structure 1 previously described, consists of a fabric container or form 46 filled with concrete. In this particular instance the fabric container 46 is generally in the shape of a cube, with each side 47 being constructed of a heavy-duty industrial fabric such as woven polypropylene and stitched to the adjacent sides by lock stitching 48. As an example, one such container configuration has a base of approximately 42"×42" and a height of approximately 42". Such a container when filled with concrete will stretch somewhat, and the sides 47 will round out to the generally semi-spherical shape shown in FIG. 6 thus to provide a concrete structure containing approximately 54 cubic feet or two cubic yards of concrete weighing approximately 8,000 lbs. However, it should be understood that the size and shape of the fabric container may be varied depending on the particular application.

To facilitate filling of the fabric container with concrete, the top wall (side) of the fabric container is desirably provided with a top spout 50. Also, a webbed loop 51 is desirably provided at each of the upper corners 52 of the fabric container for suspending the container from a portable support frame or rack 53 during filling of the fabric container with concrete.

Figure 7:
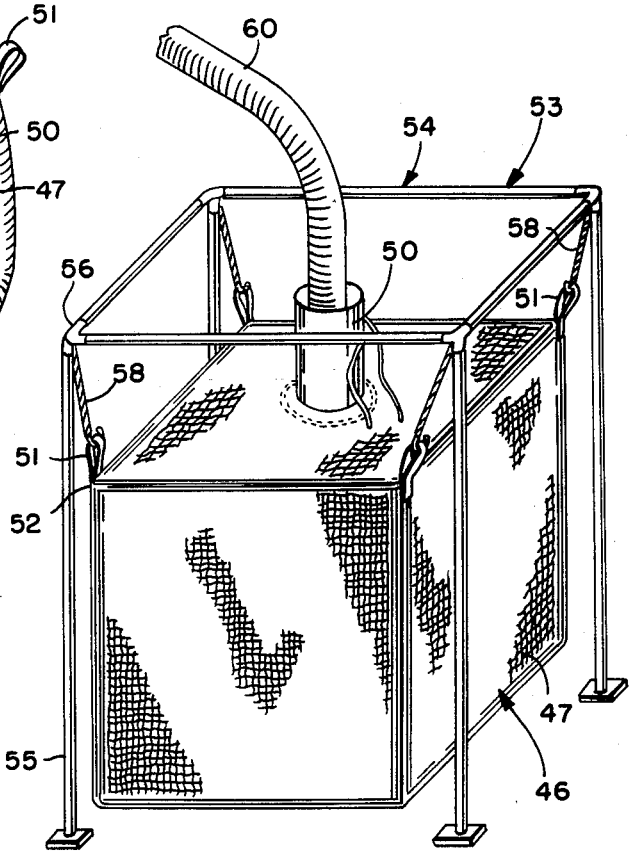
FIGS. 7 and 8 are enlarged perspective views showing a preferred method of making the concrete structure of FIG. 6.
Figure 8:
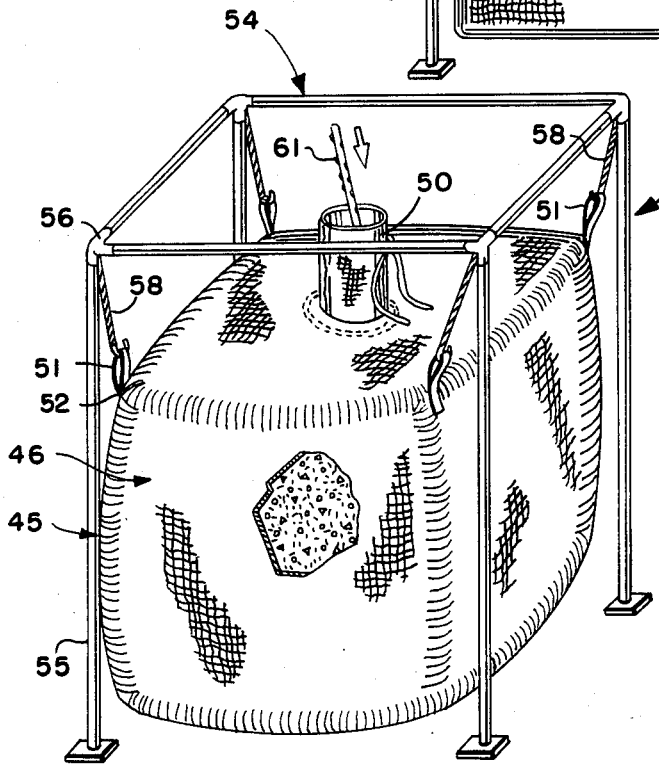

The portable rack 53 may be of the open construction shown in FIGS. 7 and 8, including a generally rectangular upper frame member 54 which is supported above the fabric container as by four support legs 55, one at each corner 56 of the upper rectangular frame member. The height and spacing between the legs 55 should be greater than the corresponding dimensions of the final concrete structure 45 so as not to interfere with the normal expansion of the fabric container 46 during the pouring operation. The top wall of the fabric container is desirably connected to the upper frame member 54 by four elastic cords 58 extending from the corners 56 of the upper frame member to the webbed loops 51 to support the fabric container in an open and upward position with the bottom wall of the container resting and supported on the ground while concrete is poured or chuted into the container through the top spout 50.

In this case, it is intended that the fabric container 46 be placed in the final desired position before concrete is introduced into the fabric container so that once the fabric container is filled with concrete, there is no need to move it. In most situations, a concrete pump will be needed to pump the concrete into the fabric container through a hose 60 extending into the top spout 50, in that truck access to most shorelines is unlikely. However, such filling of the fabric container with concrete while in place in the final desired location of the concrete structure eliminates the need for having to use a crane or barge to relocate the concrete structure, thereby substantially reducing installation costs.

By making the fabric container out of a suitable breathable fabric, the fabric container may be located within or under water and still be filled in place with concrete, in that the breathable fabric allows the water within the fabric container to be expelled through the interstices of the fabric when the concrete is introduced. Also, as previously indicated, any entrained air and water in the concrete will be expelled through the fabric during such filling operation, leaving an almost flawless concrete surface under the fabric with no need to vibrate the container as is normally required when conventional steel or wood forms are used.

The concrete may be reinforced with various fibers of the type previously described, or conventional steel reinforcement bars 61 may be inserted into the concrete in the fabric container through the top spout 50 after the hose 60 has been removed as shown in FIG. 8 for added strength.

Upon completion of the filling operation, the top spout 50 may be tied shut or left open as desired. The portable rack 53 should be left in place to provide continued support for the concrete structure for a period of time, for example, two to three hours, until the concrete sufficiently sets up so that it is self-supporting. Thereafter the rack may be removed simply by disconnecting the shock cords 58 from the webbed loops 51 and lifting the rack to an adjacent site for supporting another concrete structure to be poured in place. For increased production, several such portable racks 53 may be set up to support several fabric containers at one time which then may be consecutively filled with concrete.

Figure 9:
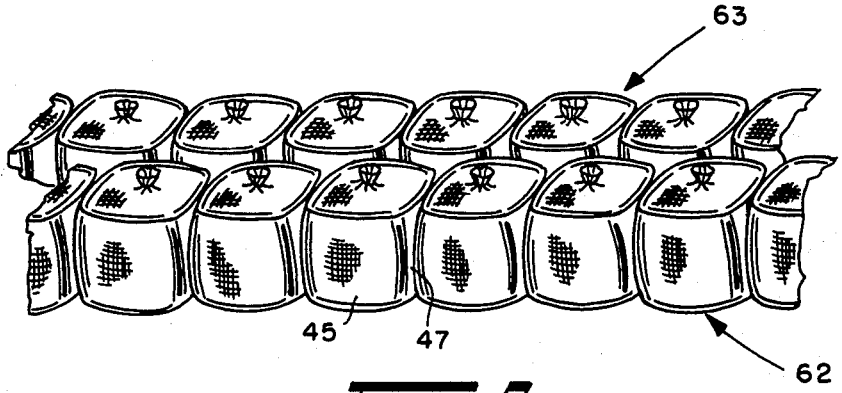
FIG. 9 is a perspective view of a breakwall or the like consisting of one or more rows of concrete structures of the type shown in FIG. 6.
Figure 10:
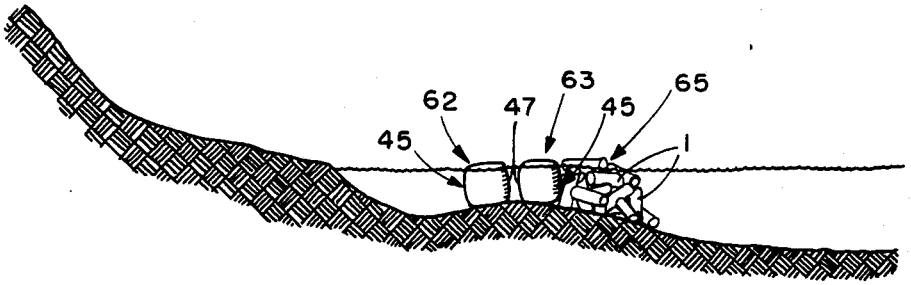
FIG. 10 is a schematic side elevation view showing the placement of a plurality of concrete structures of the type shown in FIG. 1 in conjunction with concrete structures of the type shown in FIG. 6 adjacent a shoreline to provide both shore protection and wave control.

The semi-spherical sides 47 of such concrete structures 45 deflect and disperse the wave forces acting thereon thereby offering greater resistance to premature failure from wave force. Also, the concrete structures may be placed side-by-side in a single row 62 with the semispherical sides 47 of adjacent concrete structures in tangency with each other as shown in FIG. 9 to allow for some passage of water around the concrete structures so that the concrete structures do not form a solid wall in the face of the wave forces. Two or more rows 62, 63 of such concrete structures 45 may also be placed relatively close together as shown in FIGS. 9 and 10, with the concrete structures in one row 62 staggered somewhat relative to the concrete structures in the adjacent row 63 so that the center of the concrete structures of one row are substantially in line with the contacting sides of the adjacent row to further deflect and disperse the wave forces as they pass from one row to the next.

As further protection against wave damage to one or more rows 62, 63 of the concrete structures shown in FIG. 9, a number of dolosse 1 of the type previously described can be randomly piled one on top of the other to form a wall 65 on the leeward side of the row 63 of concrete structures 45 facing away from the shore to provide an armor therefor to absorb and disperse some of the wave energies before they hit the concrete structures 45 therebehind. The rows 62, 63 of concrete structures are normally placed fairly close to the shoreline in relatively shallow water, whereas the dolosse are normally placed closely adjacent the side of the outermost row 63 facing away from the shore. As an example, the two rows 62, 63 of concrete structures 45 may extend parallel to the shoreline and spaced therefrom in water having a measured depth of approximately four to five feet, whereas the dolosse may be stacked one on top of the other further out from the shoreline closely adjacent the outermost row 63.

Although the invention has been shown and described with respect to certain preferred embodiments, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A method of making a concrete structure for use in shore protection or wave control utilizing a fabric container having an opening in one end thereof comprising the steps of suspending such one end of such fabric container having such opening therein around the outer periphery of such one end above the ground from a support frame above the fabric container, and filling such container with concrete through such opening therein while such one end is thus suspended around such outer periphery from such support frame, such one end of such container containing such opening being suspended from such support frame by elastic cords connected to the outer periphery of such one end while the oppopsite end of such container is supported on the ground.

2. The method of claim 1 whrein the fabric container is filled with concrete at its final desired position for the concrete structure.

3. The method of claim 1 wherein a plurality of such fabric containers are transported to the site where a plurality of such concrete structures are to be used for shore protection or wave control and the fabric containers are filled with concrete at such site.

4. The method of claim 1 wherein a concrete pump is used to pump the concrete from a mixer to the opening in the fabric container through a hose while such one end of such fabric container is suspended around such outer periphery from such support frame.

5. The method of claim 4 wherein the concrete that is used to fill the fabric container is a fiber reinforced concrete.

6. The method of claim 1 wherein such fabric container is made of a breathable industrial grade fabric which provides for the release of entrapped air and surface water from the concrete while retaining moisture for curing of the concrete during the filling of such container with concrete only through such opening in such one end.

7. The method of claim 1 wherein a plurality of such fabric containers are filled with concrete in place in a row in the final desired position for such concrete structure for use in shore protection or wave control, each such fabric container being of generally cube shape and having such opening in the top thereof through which concrete is poured into each such container, and the sides of adjacent fabric containers upon being filled with concrete are generally semi-spherical in shape and in tangency with each other to allow for passage of water around such concrete-filled fabric containers.

8. The method of claim 7 wherein such fabric containers are filled with concrete in place in two rows in the final desired position for such concrete structure with the semi-spherical sides of adjacent concrete-filled fabric containers in each row in tangency with each other.

9. The method of claim 8 wherein the concrete-filled fabric containers in one row are staggered relative to the concrete-filled fabric containers in the other row so that the center of the concrete-filled fabric containers of one row are substantially in line with the contacting sides of the other row to deflect and disperse the wave forces as they pass from one row to the next.

10. A method of making a concrete structure for use in shore protection or wave control utilizing a fabric container having an opening in one end thereof comprising the steps of suspending such one end of such fabric container having such opening therein around the outer periphery of such one end above the ground from a support frame above the fabric container, and filling such container with concrete through such opening therein while such one end is thus suspended around such outer periphery from such support frame, the fabric container having a pair of cross members generally perpendicular to each other in different planes and an intermediate member connecting such cross members together at their mid points, one of the cross members being closed at opposite ends by fabric end walls, and the other of the cross members being open at one end to provide such opening therein and closed at the other end by a fabric end wall, further comprising the steps of supporting the fabric container by such support frame so that the other cross member is substantially vertical with the open end thereof at the upper end of the other cross member and the closed end thereof is supported at the bottom, and the one cross member and intermediate member are horizontally supported at a level intermediate the length of the other cross member during filling of the entire fabric container with concrete only through such open end while such open end is suspended around such outer periphery from such support frame.

11. The method of claim 10 wherein an opening is provided in the ground in substantially vertical alignment with the open end of the other cross member for receipt of the closed end of the other cross member, the depth of the opening in the ground being such that the closed end of the other cross member is supported by the bottom of the opening and the one cross member and intermediate member are supported by the ground adjacent the opening.

12. The method of claim 11 wherein the open end of the other cross member is supported above ground level at a height such that the other cross member is maintained substantially vertical and the one cross member and intermediate member are maintained substantially horizontal by direct contact wth the ground during filling of the fabric container with concrete only through such open end.

13. The method of claim 11 wherein during filling of the fabric container with concrete only through such open end, first the concrete fills the portion of the vertical cross member below ground level, then the concrete travels through the intermediate member and fills the horizontal cross member and intermediate member, and finally the concrete fills the upper portion of the vertical cross member above ground level.

14. The method of claim 11 wherein such outer periphery of such open end of the fabric container is connected to the support frame by elastic cords which permit some sagging of the vertical cross member as the vertical cross member is filled with concrete.

15. The method of claim 14 wherein the support frame consists of a pair of semi-cylindrical members hinged together along one edge and having a releasable latch at the other edge, and a pair of folding support legs extend outwardly from each semi-cylindrical portion to support the support frame above the ground.

16. The method of claim 11 wherein one or more trenches are provided at the site to provide a plurality of such openings in the ground for receipt of the other cross member of each of a plurality of spaced apart fabric containers, each of such fabric containers being supported and filled with concrete in the manner previously described.

17. A method of making a concrete structure for use in shore protection or wave control utilizing a fabric container having an opening in one end thereof comprising the steps of suspending such one end of such fabric container having such opening therein around the outer periphery of such one end above the ground from a support frame above the fabric container, and filling such container with concrete through such opening therein while such one end is thus suspended around such outer periphery from such support frame, such support frame consisting of a rod-like frame open in the center and supported above the ground by a plurality of angularly extending support legs, and the outer periphery of such one end of such fabric container being connected to such rod-like frame by a plurality of elastic cords extending therebetween.

18. The method of claim 17 wherein such fabric container is generally in the shape of a cube having a top spout in such one end through which concrete is poured into such fabric container.

19. The method of claim 18 wherein webbed loops are provided at the corners of such one end of such fabric container for use in suspending such one end from such rod-like frame by such elastic cords during filling of such container with concrete.

20. A method of making a concrete structure for use in shore protection or wave control utilizing a plurality of fabric containers each having an opening in one end thereof comprising the steps of suspending such one end of each such fabric containers having such opening therein around the outer periphery of such one end above the ground from a support frame above each fabric container, and filling each such container with concrete through such opening therein while such one end is thus suspended around such outer periphery from such support frame, a plurality of such fabric containers being filled with concrete in place in the final desired position for such concrete structure for use in shore protection or wave control, each such fabric container being of generally cube shape and having such opening in the top thereof through which concrete is poured into each such container, and the sides of adjacent fabric containers upon being filled with concrete being generally semi-spherical in shape, such fabric containers being filled with concrete in place in two rows in the final desired position for such concrete structure with the semi-spherical sides of adjacent concrete-filled fabric containers in each row in tangency with each other to allow for passage of water around such concrete-filled fabric containers, the concrete-filled fabric containers in one row being staggered relative to the concrete-filled fabric containers in one row so that the center of the concrete-filled fabric containers of one row are substantially in line with the contacting sides of the other row to deflect and disperse the wave forces as they pass from one row to the next, and a plurality of additional fabric containers also being filled with concrete in place in another row spaced from such two rows of concrete-filled fabric containers, each of such additional concrete-filled fabric containers in such another row comprising a pair of cross members, such cross members being generally perpendicular to each other in different planes, and an intermediate member connecting such cross members together at their midpoints, one of such cross members being closed at opposite ends by fabric end walls, and the other of such cross members being open at one end and closed at the other end to permit filling of such additional fabric containers in such another row with concrete through such open end, such additional concrete-filled fabric containers in such another row being randomly piled one on top of the other closely adjacent the side of the outermost row of such first two rows of concrete-filled fabric containers facing away from the shore.

* * * * *